US010215484B2

(12) United States Patent
Luther

(10) Patent No.: US 10,215,484 B2
(45) Date of Patent: Feb. 26, 2019

(54) CASCADING ICE LUGE

(71) Applicant: Stephen John Luther, Terryville, CT (US)

(72) Inventor: Stephen John Luther, Terryville, CT (US)

( * ) Notice: Subject to any disclaimer, the term of this patent is extended or adjusted under 35 U.S.C. 154(b) by 113 days.

(21) Appl. No.: 15/367,210

(22) Filed: Dec. 2, 2016

(65) Prior Publication Data

US 2017/0146290 A1 May 25, 2017

Related U.S. Application Data

(60) Division of application No. 14/614,407, filed on Feb. 4, 2015, now Pat. No. 9,546,813, which is a continuation-in-part of application No. 12/394,128, filed on Feb. 27, 2009, now abandoned.

(51) Int. Cl.

| | |
|---|---|
| ***B67D 3/00*** | (2006.01) |
| ***F25D 31/00*** | (2006.01) |
| ***F25D 3/06*** | (2006.01) |
| ***F25C 1/22*** | (2018.01) |
| ***F25D 3/02*** | (2006.01) |

(52) U.S. Cl.

CPC ..... *F25D 31/002* (2013.01); *B67D 3/0009* (2013.01); *F25C 1/22* (2013.01); *F25D 3/02* (2013.01); *F25D 3/06* (2013.01); *F25C 2400/06* (2013.01); *F25D 2303/081* (2013.01); *F25D 2303/085* (2013.01); *F25D 2331/811* (2013.01); *F25D 2400/28* (2013.01); *F25D 2500/02* (2013.01)

(58) Field of Classification Search

CPC .... F25D 31/002; F25D 3/06; F25D 2331/811; F25D 2303/081; F25D 2303/085; F25D 2500/02; F25C 1/22; B67D 3/0009

See application file for complete search history.

(56) References Cited

U.S. PATENT DOCUMENTS

| | | | | |
|---|---|---|---|---|
| 1,928,594 A | 9/1933 | Kearney | | |
| 6,763,675 B1 * | 7/2004 | Fleeman | ..... | B67D 3/0009 62/386 |

* cited by examiner

*Primary Examiner* — Frantz Jules
*Assistant Examiner* — Webeshet Mengesha
(74) *Attorney, Agent, or Firm* — Ingenium Patents LLC; Peter R. Kramer

(57) ABSTRACT

Embodiments of ice luge apparatuses and methods for making cascading ice luges are disclosed. Apparatuses embodying the principles of the invention feature shelves in a stepwise configuration and alternative configurations. The shelves are positioned by supporting structures. Ice blocks can be frozen in trays such that pre-formed lanes are formed in the ice blocks. The trays can be of convenient size that can be placed in a conventional household freezer. Ice blocks can be arranged and oriented so that a liquid or beverage placed on the uppermost ice block will flow in the preformed lanes in a cascading manner thereby rapidly cooling the beverage with minimal dilution.

5 Claims, 10 Drawing Sheets

CASCADING ICE LUGE

CROSS-REFERENCE TO RELATED APPLICATIONS

The present application for patent is a Divisional application of nonprovisional application Ser. No. 14/614,407 filed Feb. 4, 2015 and claims priority benefit of application Ser. No. 14/614,407 which is hereby expressly incorporated by reference herein. Application Ser. No. 14/614,407 is a continuation of and claims priority benefit of application Ser. No. 12/394,128 filed Feb. 27, 2009, now abandoned. The present application also claims priority benefit to nonprovisional application Ser. No. 12/394,128, which is hereby expressly incorporated by reference herein.

BACKGROUND OF THE INVENTION

Field of the Invention

The subject matter of this application pertains to ice luges, particularly ice luges used for cooling and serving beverages.

Description of Related Art Including Information Disclosed Under 37 CFR 1.97 and 1.98.

Ice luges have been in popular use for rapid chilling of beverages at parties and gatherings of people where beverages, typically containing alcohol, are served. Two types of ice luges, large sculpted ice blocks and small molded ice blocks, have been in use for serving rapidly chilled beverages. The first type of ice luge consists of a large block of ice several feet long sculpted so that the luge contains channels or lanes. The upper surface of the ice luge slopes downward. A drink is poured at the elevated end of the luge, and the liquid travels through its lane and emerges from the lower end of the luge thereby dispensing the liquid into a drinking vessel that is placed to receive the chilled beverage. This type of ice luge features a long transit path. Fabricating a large block of ice requires freezing in a commercial walk-in freezer which most individuals do not have access to. Long transit path ice luges also require skill to sculpt the ice block and significant labor costs can be incurred. Furthermore, transporting large ice luges is inconvenient because of cumbersome size and heavy mass of the objects. Some advantages of long transit path ice luges are that they add ambiance to a party and produce drinks with superior quality.

Ice luges prepared from a single plastic mold, small enough to be accommodated by a typical household freezer, have also been used. An advantage of fabricating ice luges from a small mold is that a walk-in freezer is not required. The ice luges produced from this type of apparatus are characterized by a short transit path. Since the degree of cooling depends upon the amount of time that the beverage is in contact with the ice surface, slower transit speed is required with a short path ice luge. Slower transit speeds are achieved by reducing the angle of incline. A disadvantage of shorter transit speed is increased dilution of the drink, which adversely affects the quality of the drink that is dispensed.

BRIEF SUMMARY OF THE INVENTION

In accordance with the subject matter of this application the inventive concept of the invention includes ice luges, methods, and apparatuses and variations thereof for preparing ice blocks with preformed lanes or channels, and which provide for stable placement of the ice blocks in stepwise configuration on a supporting scaffold. The ice blocks so arranged forming a cascading ice luge which can be used for cooling of drinks, inter alia, under optimal conditions for serving.

BRIEF DESCRIPTION OF THE SEVERAL VIEWS OF THE DRAWING(S)

Figure 6:
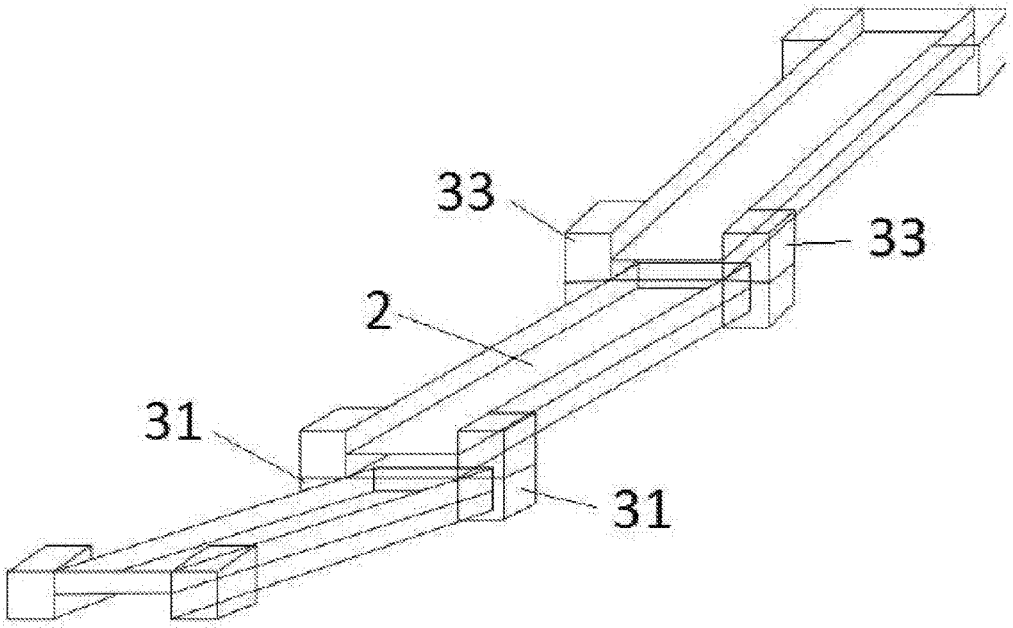

FIG. 6 Embodiment with Angled Shelves

Figure 7:
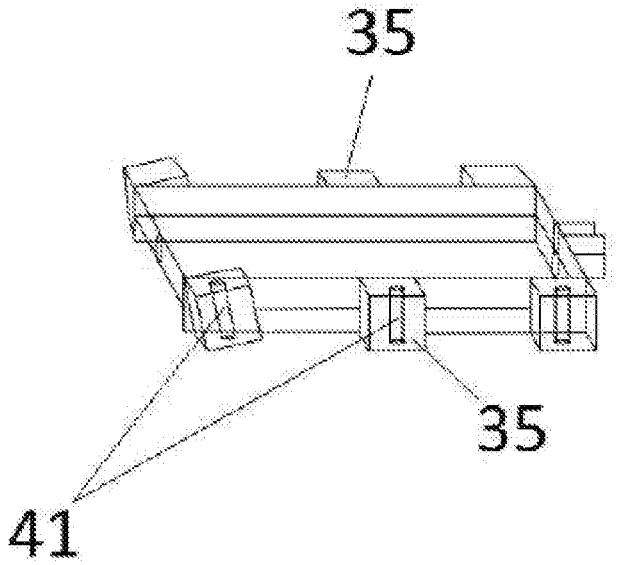

FIG. 7 Angled Shelf with Mounting Blocks

Figure 8:
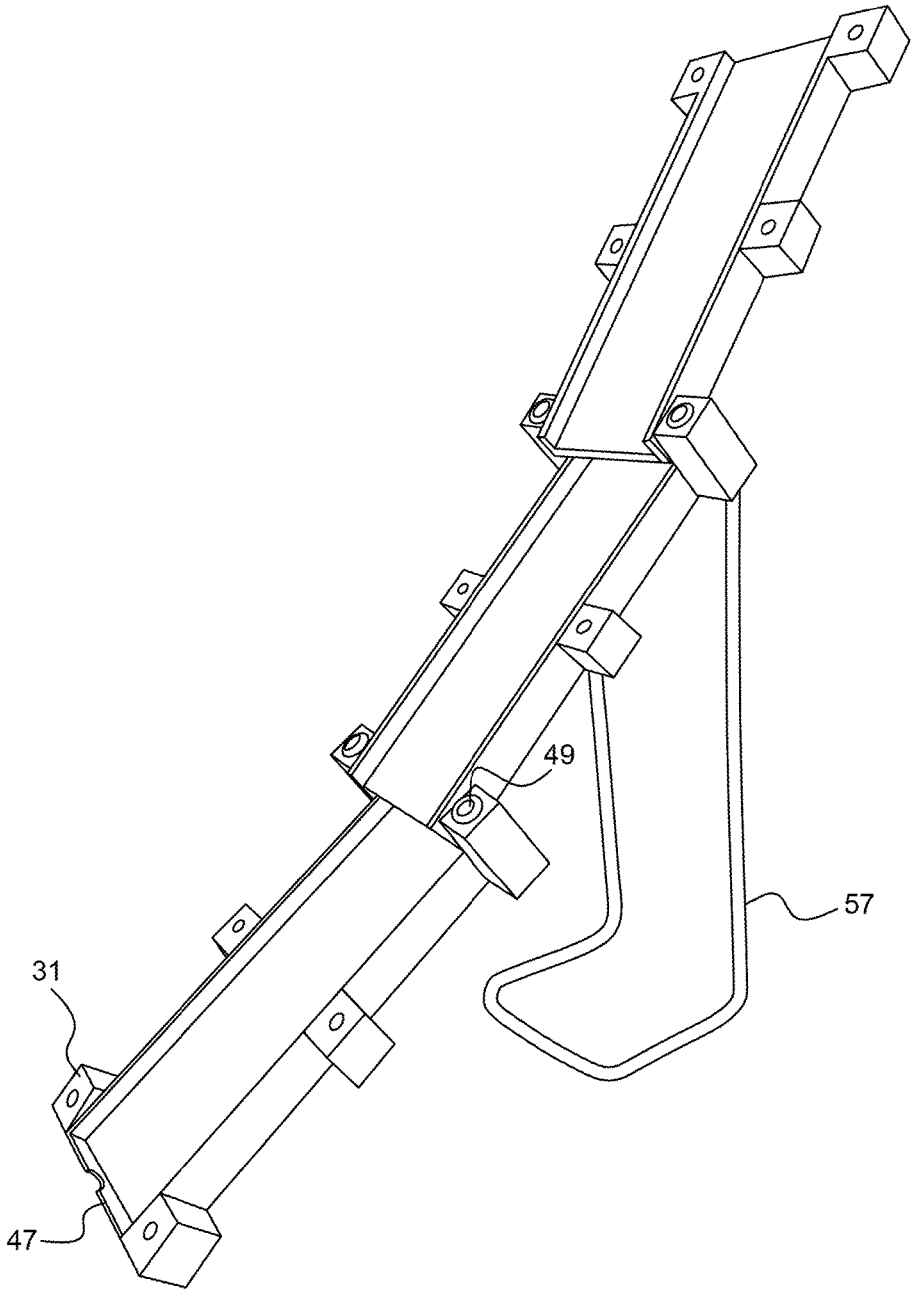

FIG. 8 Embodiment with Angled Shelves Mounting Blocks and Front Panel

Figure 9:
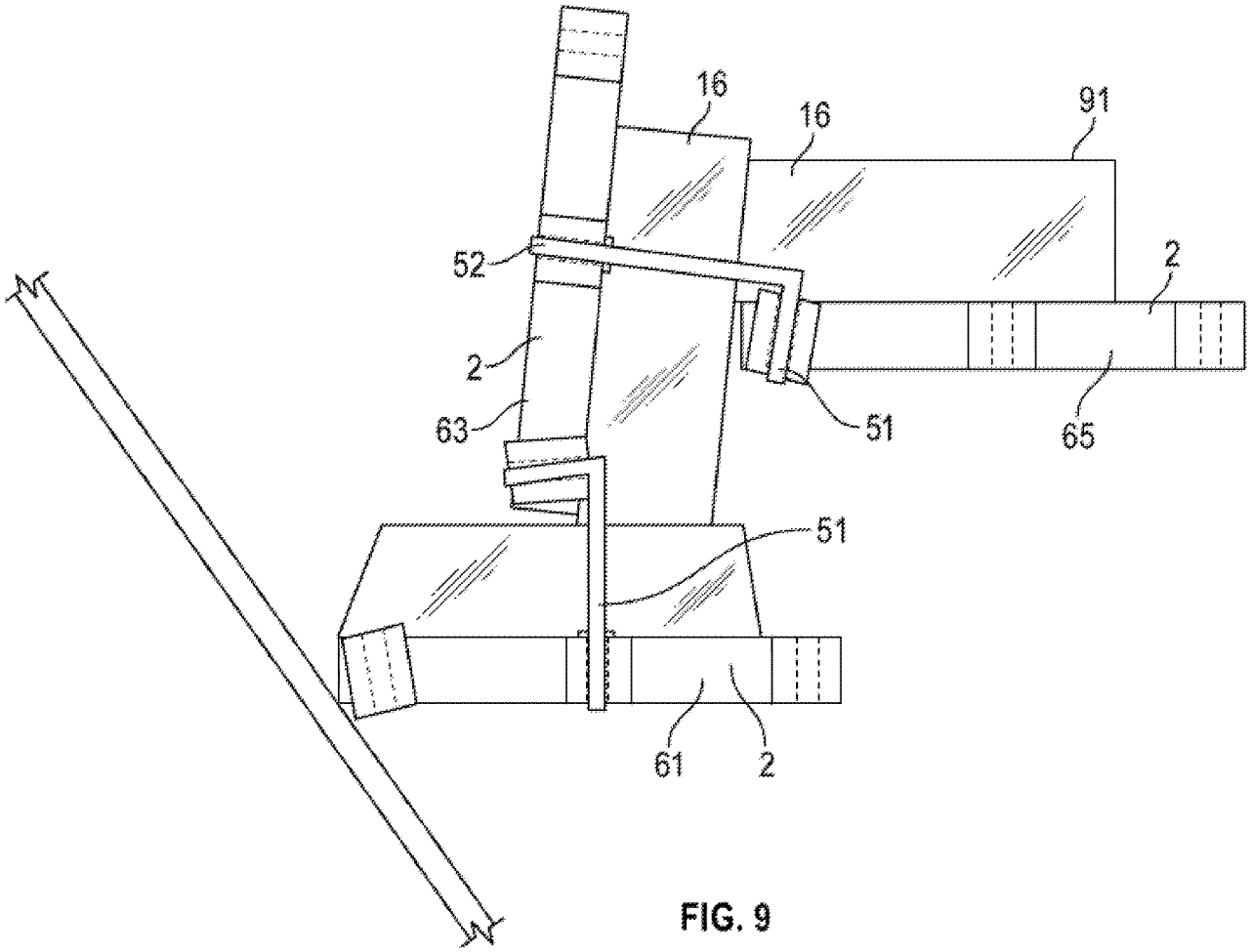

FIG. 9 Embodiment with Z Configuration

Figure 10:
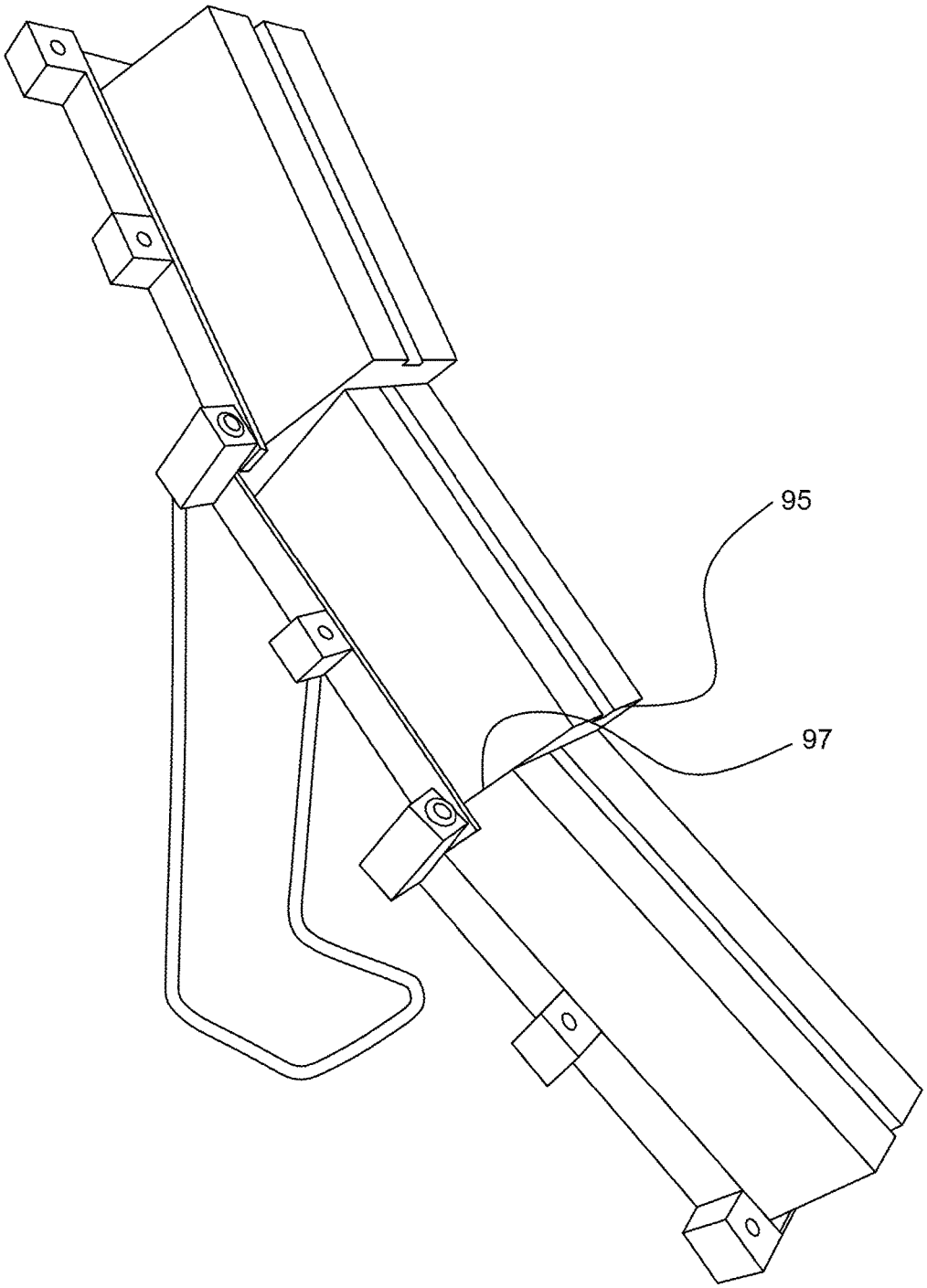

FIG. 10 Embodiment with Angled Shelves and Ice Blocks in Place

DETAILED DESCRIPTION OF THE INVENTION

The ice luges known in the related art fall into two categories. Prior ice luges had lanes that were either preformed or sculpted. Large ice luges feature a long transit path and are fabricated from a large block of ice which is subsequently sculpted to form a frozen declined plane with lanes for serving beverages. The Ice luges with pre-formed lanes have been made with an apparatus which is a moderately small grooved tray in which water is frozen. Ice blocks thereby produced have pre-formed lanes to accommodate a flow of beverage or liquid. The tray can be inverted and used to support the ice block for use in chilling and dispensing drinks. Luges produced from smaller trays, although more convenient to fabricate than long transit path luges, have a shorter transit path and consequently produce chilled drinks of inferior quality. As noted above, long transit path ice luges require a walk-in freezer to prepare large and very heavy blocks of ice, which subsequently must be laboriously sculpted. It remained for the present inventor to recognize that an apparatus for making a cascading ice luge would provide ice luges possessing the benefits of a long transit path ice luge and the convenience of preparing smaller ice luges from small freezer trays.

Figure 1:
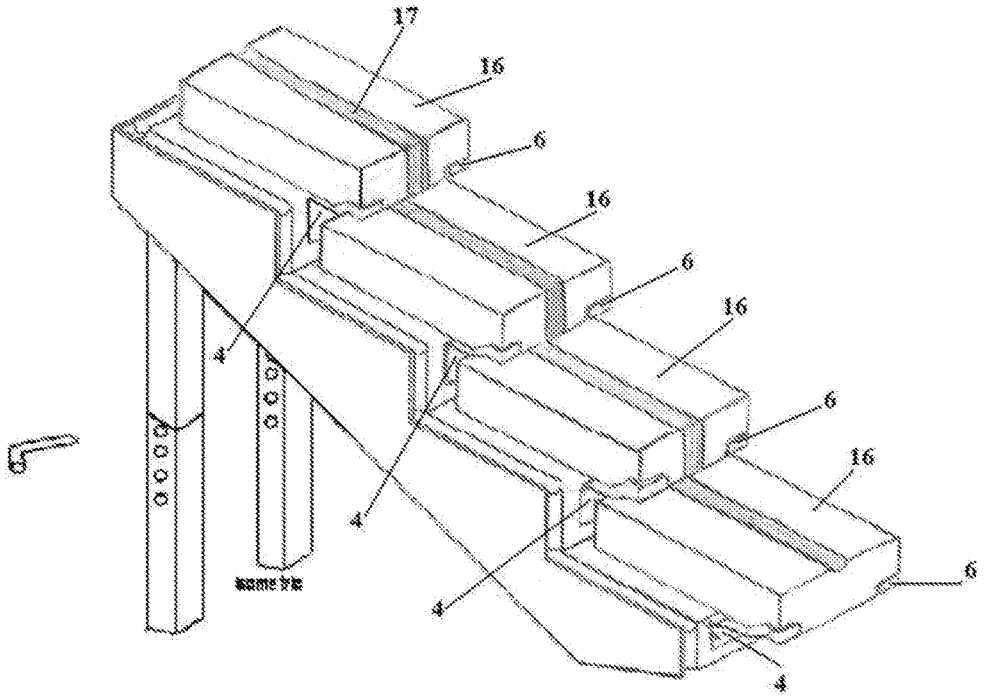
FIG. 1 Depicts an embodiment of a scaffold and ice luge of the current invention. Ice trays not shown.
Figure 2:
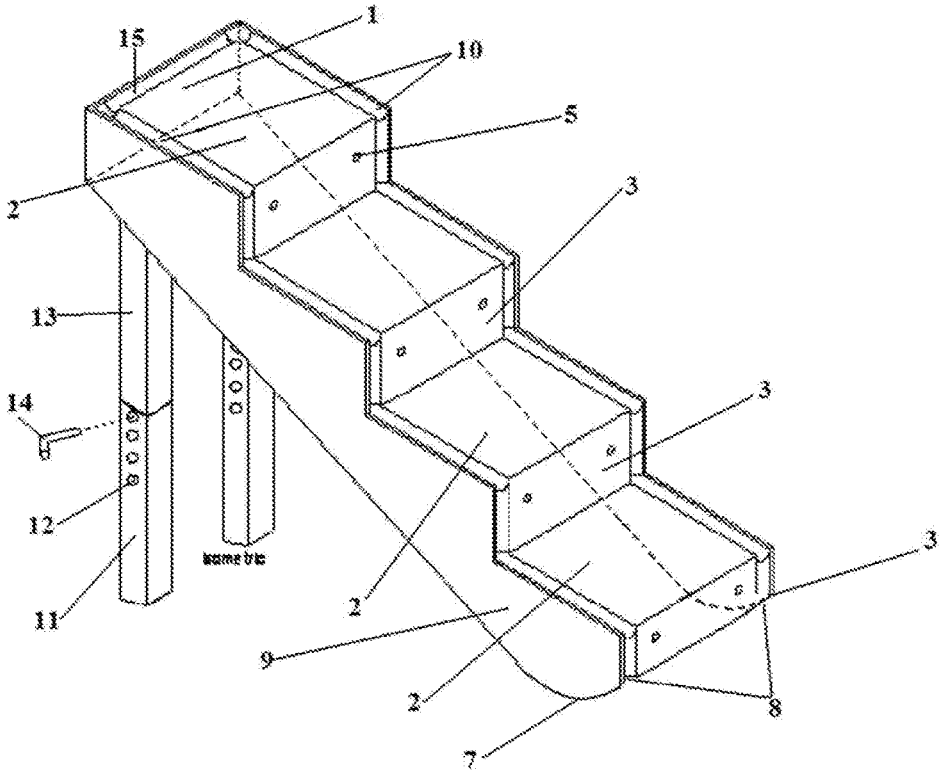
FIG. 2 Depicts an embodiment of the scaffold of the current invention. Brackets are not shown.
Figure 3:
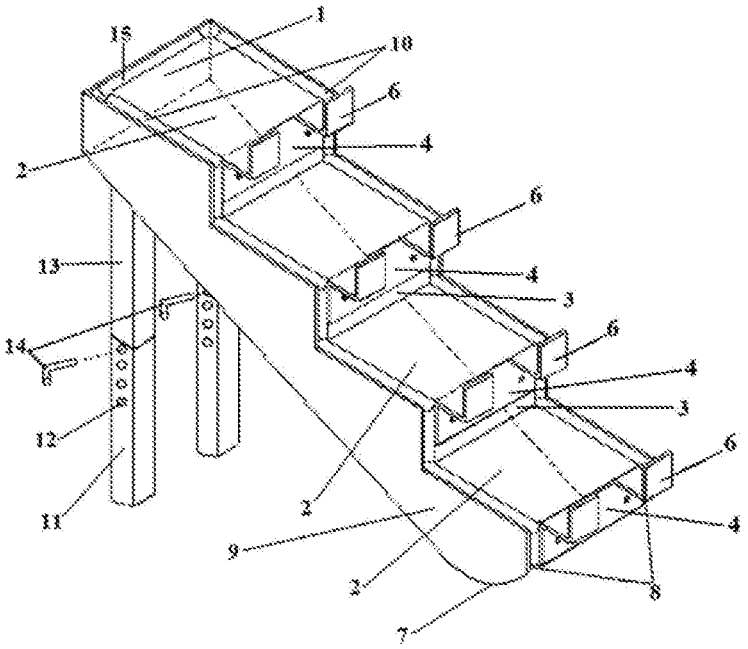
FIG. 3 Depicts an embodiment of the scaffold of current invention. The trays are not shown.
Figure 4:
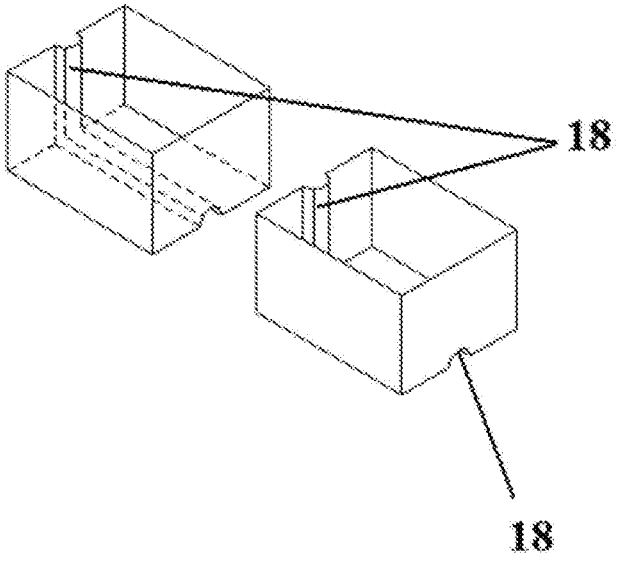
FIG. 4 Depicts ice trays according to an embodiment of the invention.
Figure 5:
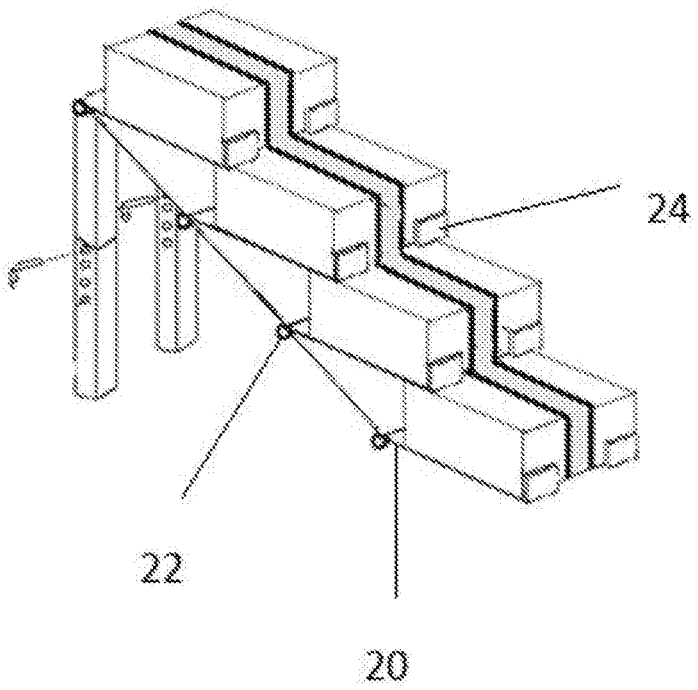
FIG. 5 Depicts an embodiment of a scaffold and ice luge of the current invention. Ice trays not shown.

FIGS. 1 and 3 depict an apparatus embodying the principles of the present invention. The apparatus comprises a stepwise configured scaffold, FIGS. 2 and 3, with one end elevated and supported by elongated support members. The apparatus may be constructed from metal, plastic or other suitable sturdy materials. The lower end rests on rounded supports (7), 'feet', fashioned from the side panels (9). The support members (hereinafter "legs") are affixed to the elevated end of the scaffold, are shown with two-piece construction with upper (13) and lower (11) members. The lower member which has a smaller cross sectional area can be slidably fitted into the upper member. Holes (12) are positioned so that pins (14) can be inserted to adjust the height of the elevated end of the scaffold. The scaffold further comprises a series of shelves (2) configured in stepwise configuration. Vertical members (3) connect each shelf and have holes (5) to which brackets (4) can be affixed with screws and nuts. Alternatively, brackets can be glued in place with an adhesive. The brackets so affixed project foreword from the front of each step and have an upturned tab (6) at the fore end. It should be appreciated that such flat members with upturned tabs, i.e., 'retaining members', with the functionality of shelves and affixed brackets can be achieved by construction of flat panels with integral tabs. Channels are positioned on the periphery of the apparatus as shown. A rear channel (15) is formed on the upper surface of the rear panel (1). Two side channels (10) are formed on the upper surface of each of two side panels (9). Together the rear and side channels comprise a peripheral channel, which terminates at the efflux ports (8). The apparatus further comprises a set of trays, see FIG. 4 which depicts two trays of a set, with each tray bearing a groove (18) or multiple grooves. The dimensions of the trays are such that the ice blocks formed therefrom (16) FIG. 1, can be placed on each shelf of the scaffold and are bounded with clearance by the peripheral channel. The uppermost ice block is bounded on three sides, i.e., by the rear channel and two side channels; the remaining blocks are bounded by the parallel side channels each on two sides as shown. Ice blocks (16) bearing pre-formed lanes (17) are positioned on the scaffold shelves with one ice block being placed on each shelf to form a cascading ice luge. The ice blocks are arranged so that the distal end of each ice block slightly overhangs the proximal end of the ice block immediately below it. The overlap between adjacent ice blocks optimally should not exceed about 15 percent.

Ice blocks are prepared by filling the trays with water. Subsequently the trays are placed in a freezer until solid ice is formed. After freezing, the ice blocks are placed on the scaffold shelves as shown in FIG. 2 with preformed lanes (17) facing upward. The bracket tabs (6) secure the ice blocks in place on their respective shelves. Water accumulating from melting ice enters the peripheral channel, which is formed from the rear and side channels (15) and (10), respectively, and is discharged at the efflux ports (8). The height of the elevated end of the luge can be adjusted by placing the pins (14) in the appropriate holes (12). Drinks are poured into lanes (17) at the elevated end of the ice luge, and are rapidly cooled during transit along their lanes, and are collected as each liquid drink emerges from the lower end of the ice luge from their respective lanes.

The foregoing merely illustrates the principles of the invention. For example, a cascading ice luge can be manufactured with a spiral cascading ice bed. Additionally, spiral ice luges can be fabricated that are stackable thereby increasing the length of the luge.

In another embodiment, a housing or scaffold holds a series of ice-block holders or retaining members (20) that are affixed to the scaffold. Retaining members are affixed in a descending stepwise arrangement. Each retaining member is affixed to a dowel or cross-member (22) such that it can pivot about the axis defined by each cross-member. The free end of each retaining member has an upturned tab (24). Ice blocks can be placed on each retaining member. The lower end of each retaining member rests on each successive ice block, except for the lowest retaining member. The retaining members are oriented with a decline angle relative to horizontal so that applied liquid will flow from uppermost ice blocks to the lower ice blocks.

In yet another embodiment, FIG. 6, shelves (2) are arranged in a cascading configuration with each shelf angled at a pitch of about 12 degrees relative to its adjacent shelves. From the base shelf to the uppermost shelf, the angle relative to the ground increases by about 12 degrees. The lowest shelf has a front panel (47) that acts as a retaining member to keep the ice blocks from sliding off the luge apparatus. This embodiment has a support bracket preferably made of tubular material as shown (57). The angle of the 'L' configuration is about 84 degrees in order to be slightly less than perpendicular. The support brackets have threaded portions that can engage the threaded holes (41). The shelves (2) have pairs of mounting blocks, front mounting blocks (31) and rear mounting blocks (33). A pair of center mounting blocks, FIG. 7 (41), can allow additional configurations for the shelves. The front mounting blocks (31) are angled at 12 degrees to provide for the progressively increasing pitch of each higher shelf. The mounting blocks have threaded holes (41) which can be used for connecting either support brackets or for joining successive shelves using a threaded bolt (49). The front-end FIG. 10 (95) of each block is preferably taller than the rear end (97) of each adjacent contacting block.

Using at least two support 'L' brackets (51) a luge can be constructed wherein the threaded portions of the brackets (52) engage the threaded holes in the mounting blocks allowing for a "Z" configuration wherein the lowest block, which might be placed on a table top, is placed on the base shelf (61). A connecting shelf (63) holds an ice block near perpendicular at an 84-degree angle to the lowest ice block. A third shelf, the upper shelf (65), is joined to the connecting shelf by the 'L' shaped bracket which at threaded end of its longer portion is inserted into the middle mounting block of the connecting shelf and the threaded portion of its shorter portion is inserted and engaged with the front mounting block of the upper shelf. The base shelf and connecting shelf are similarly connected by L brackets.

It thus will be appreciated that those skilled in the art will be able to devise numerous alternative arrangements that, while not shown or described herein, embody the principles of the invention and thus are within its spirit and scope.

I claim:

1. An apparatus for rapid chilling and dispensing of beverages comprising, freezing trays, said freezing trays configured for freezing water into ice blocks, said trays further configured to form a preformed lane on each of the ice blocks, a plurality of shelves, each of said shelves having a front end and having a rear end, each of said shelves having a pair of front mounting blocks and having a pair of rear mounting blocks, said front and rear mounting blocks having threaded holes for joining the shelves, said front mounting blocks being angled to provide for progressively increasing the pitch of each higher shelf when said shelves are joined, said shelves comprised of an upper shelf, a lowest shelf, and an intermediate shelf, said lowest shelf having a retaining member, threaded bolts, said threaded bolts being configured to be received by said threaded holes, whereby the rear end of the shelves may be joined to the front end of adjacent shelves, a support bracket configured to support the upper shelf, said support bracket further configured to rest on a supporting surface such as a table or floor, said support brackets further having threaded portions which engage said threaded holes of said mounting blocks, a retaining member, said retaining member affixed to the lowest shelf and positioned wherein the ice blocks can be securely positioned on said shelves whereby the beverage applied to a lane of the ice block on the upper shelf will cascade into a lane of each successive lower ice block without loss of beverage.

2. An apparatus for rapid chilling and dispensing of beverages comprising, freezing trays, said freezing trays configured for freezing water into ice blocks, said trays further configured to form a preformed lane on each of the ice blocks, a plurality of shelves, comprising a base shelf, a connecting shelf, and an upper shelf, each of said shelves having a pair of front mounting blocks and each of said shelves having a pair of rear mounting blocks, and each of said shelves having a pair of middle mounting blocks, said middle mounting blocks positioned between said front mounting blocks and said rear mounting blocks, said front, middle and rear mounting blocks having threaded holes for joining the shelves, support means, said support means configured to support said upper shelf, said connecting shelf and said base shelf wherein the shelves are oriented in a Z configuration, means to connect the front mounting blocks on the upper shelf to the middle mounting blocks on the connecting shelf, means to connect the front mounting blocks of the connecting shelf to the middle mounting blocks of the base shelf, wherein said means to connect the front mounting blocks on the upper shelf to the middle mounting blocks on the connecting shelf and said means to connect the front mounting blocks of the connecting shelf to the middle mounting blocks of the base shelf are configured wherein the ice blocks placed on the shelves are securely oriented in a Z configuration so that a beverage applied to the lane of the ice block on the upper shelf will cascade into the lane of the ice block on the connecting shelf, and beverage from said connecting shelf will subsequently cascade into the lane on the ice block positioned on the base shelf without loss of beverage.

3. An apparatus for rapid chilling and dispensing of beverages comprising, freezing trays, said freezing trays configured for freezing water into ice blocks, said trays further configured to form a preformed lane on each of the ice blocks, a plurality of shelves, said shelves comprised of an upper shelf, a lowest shelf, and an intermediate shelf, said shelves sequentially connected front to back, said shelves arranged at an angle with respect to each adjoining shelf wherein the angle of incline of each shelf progressively increases from lowest shelf to each higher shelf, a retaining means to keep ice blocks placed on the apparatus securely in place, whereby the beverage applied to a lane of the ice block on the upper shelf will cascade into a lane of each successive lower ice block without loss of beverage.

4. The apparatus according to claim 1 further comprising wherein said front mounting blocks are angled at approximately 12 degrees.

5. The apparatus according to claim 1 further comprising wherein said front mounting blocks are angled at 12 degrees.

* * * * *